United States Patent [19]

Sleeth

[11] Patent Number: 5,044,028

[45] Date of Patent: Sep. 3, 1991

[54] WATERBED SHEET RETENTION SYSTEMS

[76] Inventor: Raymond W. Sleeth, 35 Arvene Ct., Timonium, Md. 21093

[21] Appl. No.: 589,981

[22] Filed: Sep. 28, 1990

[51] Int. Cl.[5] ..... A47C 27/08; A47G 9/00

[52] U.S. Cl. ..... 5/451; 5/496; 24/72.5

[58] Field of Search ..... 5/451, 496, 448, 508, 5/450, 482, 400; 24/72.5

[56] References Cited

U.S. PATENT DOCUMENTS

| | | | |
|---|---|---|---|
| 959,763 | 5/1910 | Lehr . | |
| 975,335 | 11/1910 | Dial . | |
| 1,913,965 | 6/1933 | Van Vechten . | |
| 2,826,766 | 3/1958 | Stoner . | |
| 3,606,622 | 9/1971 | Williams et al. . | |
| 3,838,470 | 10/1974 | May | 5/451 |
| 4,100,632 | 7/1978 | Johnson . | |
| 4,660,240 | 4/1987 | Hutton et al. | 5/451 |
| 4,698,880 | 10/1987 | Hamm | 24/72.5 |
| 4,712,260 | 12/1987 | Bissel | 5/496 |
| 4,716,608 | 1/1988 | Whitfield | 5/451 |
| 4,731,892 | 3/1988 | Bissel | 5/451 |
| 4,809,377 | 3/1989 | Lynn | 5/508 |
| 4,829,617 | 5/1989 | Dameron | 5/508 |

*Primary Examiner*—Alexander Grosz

*Attorney, Agent, or Firm*—Leonard Bloom

[57] ABSTRACT

A waterbed retention system. The system includes a stabilizing device that is carried by each side frame member of the bed being disposed above the space formed between the respective frame members and the mattress of the bed. A retaining device is fitted over the side edge of the sheet being removably secured thereto lengthwise thereof. The retaining device and the sheet are received between the frame member and the mattress, so that it can pivot slightly in the space below the stabilizing device to accommodate movement of the sheet due to stress thereon during normal use of the waterbed. This also permits the retaining device to thereafter pivot back to its normal position under the influence of the mattress, so that once the stress on the sheet is removed, the sheet will be retained on the mattress and will return to its normal smooth position without being substantially creased and without requiring frequent remaking of the bed.

23 Claims, 7 Drawing Sheets

WATERBED SHEET RETENTION SYSTEMS

FIELD OF THE INVENTION

The present invention relates to waterbeds and, in particular, to arrangements, systems and devices for retention of a sheet on a water-filled mattress.

BACKGROUND OF THE INVENTION

In recent years, there has been a marked increase in the use of waterbeds.

One of the problems with conventional waterbeds is that the sheet thereof often becomes pulled and separated from the mattress as a result of the unique movement of the water-filled mattress and stress placed on the sheet during use of the waterbed. Frequently the sheet is shifted so that the water-filled mattress is uncovered. Users of the bed must then remake the bed. When the mattress is not uncovered, movement of the sheet is such that creases and wrinkles are produced in the sheet which reduces the comfortableness of the waterbed.

In order to eliminate the problems associated with movement of the sheet, wrinkling and creasing, special sheets have been disclosed for particular use with waterbeds. These special sheets have extra pieces of material in the four corners thereof, that is cut on a diagonal, to provide a pocket. The water-filled mattress or bladder is then tucked into these four corners.

Unfortunately, in addition to expense, the use of the above described special sheets can prove problematic. Some users of waterbeds do not want to purchase special sheets and do not want to be constantly remaking the bed to separate the sheet from the blanket and then recover the mattress with the sheet. These users frequently sell the waterbed at a financial loss or otherwise dispose of the waterbed. This problem has been a brake on the sale of new waterbeds and has detracted from the use and enjoyment of waterbeds by present owners of waterbeds.

In an attempt to solve the above-mentioned problems, numerous devices have been proposed. Examples of such devices are noted, as follows:

| Patent No. | Inventor(s) | Year of Issue |
|---|---|---|
| 4,660,240 | Hutton et al | 1987 |
| 4,712,260 | Bissel | 1987 |
| 4,731,892 | Bissel | 1988 |
| 4,809,377 | Lynn | 1989 |
| 4,829,617 | Dameron | 1989 |

Furthermore, other devices of which I am aware for securing a sheet on a bed are reported as follows:

| Patent No. | Inventor(s) | Year of Issue |
|---|---|---|
| 959,763 | Lehr | 1910 |
| 975,335 | Dial | 1910 |
| 1,913,965 | Van Vechten | 1931 |
| 2,826,766 | Stoner | 1958 |
| 3,606,622 | William et al | 1971 |
| 4,100,632 | Johnson | 1978 |
| 4,698,880 | Hamm | 1987 |
| 4,716,608 | Whitfield | 1988 |

Unfortunately, due to various reasons, including the complexity and cost thereof, none of the devices of which I am aware have been successfully commercialized.

Accordingly, it can be seen that there remains a need for arrangements, systems and/or devices for waterbeds, that are simple and inexpensive, that secure and retain a conventional sheet on a waterbed in a substantially smooth condition without the sheet being substantially separated from the mattress, creased and/or wrinkled as a result of use of the waterbed.

SUMMARY OF THE INVENTION

It is a primary object of the present invention to provide arrangements, systems and devices for securing and retaining a sheet on a waterbed in a substantially smooth condition that is substantially free of creases and wrinkles.

It is a further primary object of the present invention to provide such arrangements, systems and devices that are relatively simple and inexpensive and eliminate the labor in continually remaking the bed during and after use It is a still further primary object of the present invention to provide such arrangements, systems and devices that are readily adaptable for use with conventional waterbeds and sheets therefor.

In accordance with the teachings of the present invention, there is disclosed a waterbed including a water-filled mattress having respective sides. The waterbed further includes a pair of respective side frame members running lengthwise of the bed. In this fashion, a space is formed between each side frame member and a respective side of the water-filled mattress. The waterbed is also provided with a sheet that covers the mattress. This sheet has respective side edges. A stabilizing means is carried by each side frame member being disposed above the space between the respective side frame member and the water-filled mattress. A retaining means is fitted over the side edge of the sheet and removably secured thereto lengthwise thereof. The retaining means, with the side edge of the sheet carried thereby, is received below the stabilizing means, in the space between the side frame member and the water-filled mattress. In this fashion, the retaining means can pivot slightly in the space below the stabilizing means to accommodate movement of the sheet that results from stress that occurs thereon during the normal use of the waterbed. Further in this fashion, once the stress on the sheet is removed, the retaining means will thereafter pivot back to its normal position under the influence of the water-filled mattress, whereby the sheet will be retained on the mattress and will return to its normal smooth position without being substantially creased, thereby enhancing the comfort and pleasure of the waterbed.

In another aspect of the present invention, a device is disclosed for securing and retaining a sheet including side edges on the mattress of a waterbed having a pair of respective side frame members running lengthwise of the waterbed. A stabilizing means is disposed on the respective side frame members along the side edges of the sheet. A retaining means is removably joined to the respective stabilizing means with the respective side edges of the sheet disposed therebetween. In this fashion, when the retaining means is secured to the stabilizing means the respective edges of the sheet are secured and retained therein.

These and other objects of the present invention will become readily apparent from a reading of the following specification, taken in conjunction with the enclosed drawings.

DESCRIPTION OF PREFERRED EMBODIMENTS

Figure 1:
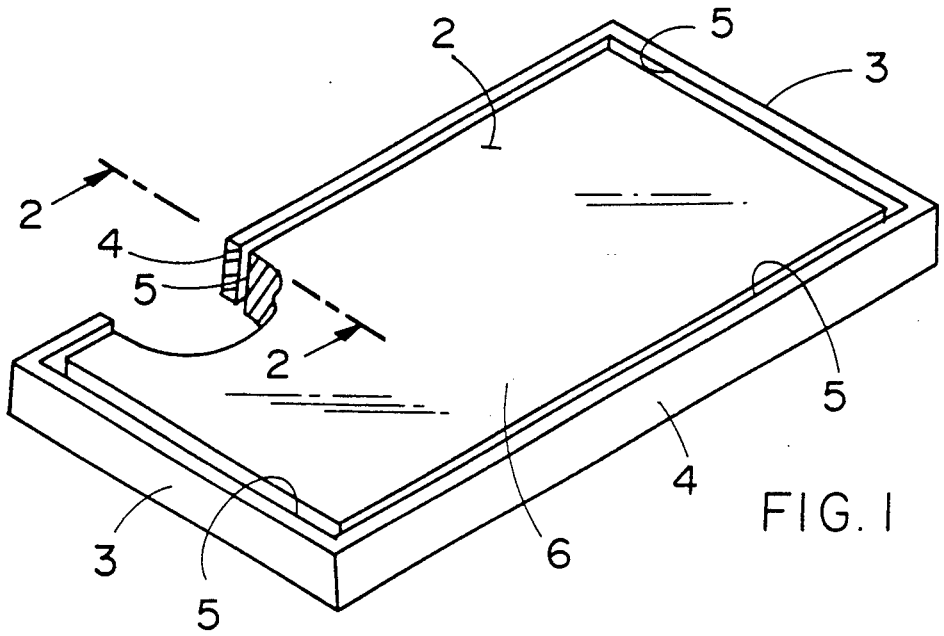
FIG. 1 is a perspective view of the arrangement of the present invention with a portion thereof removed therefrom for the sake of clarity, wherein a preferred embodiment of the device is incorporated in a conventional waterbed for retaining and securing a conventional sheet thereon.
Figure 8:
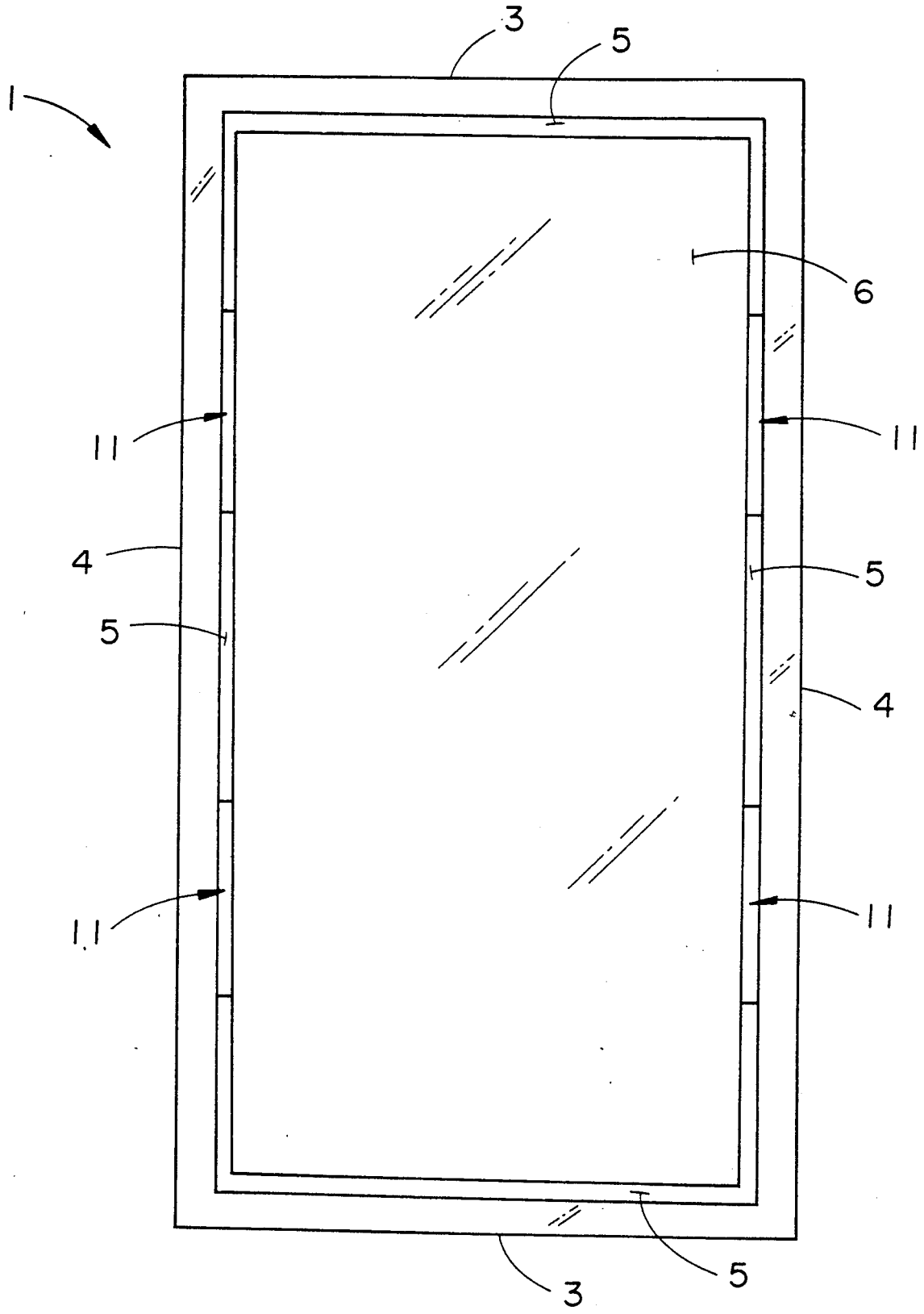
FIG. 8 is a top plan view of another arrangement of the present invention.

With reference now to the drawings, and with particular reference to FIGS. 1 and 8, the present invention is applicable for use in all waterbeds 1 of the type having a mattress or bladder 2 that is filled with water or other suitable fluid, or mixture of fluids, and a frame 3. The frame 3 has a pair of parallel side frame members 4 running lengthwise of the bed I along the respective sides of the mattress 2. A space 5 is thus defined between each side frame member 4 and a respective side of the water-filled mattress 2. Such waterbeds 2 include a sheet 6, having respective side edges 7 that cover the mattress 2.

Figure 2:
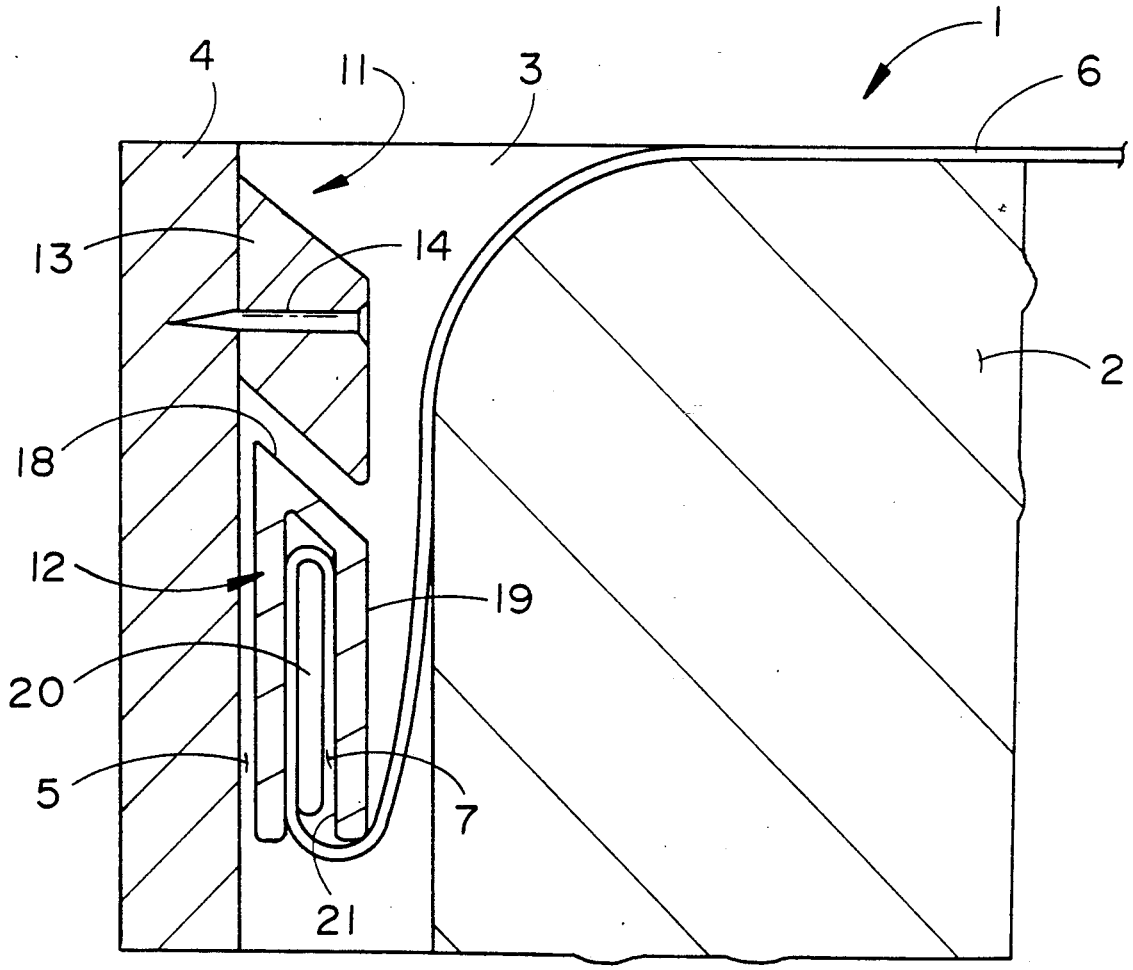
FIG. 2 is a cross-section view taken along lines 2—2 of FIG. 1.
Figure 3:
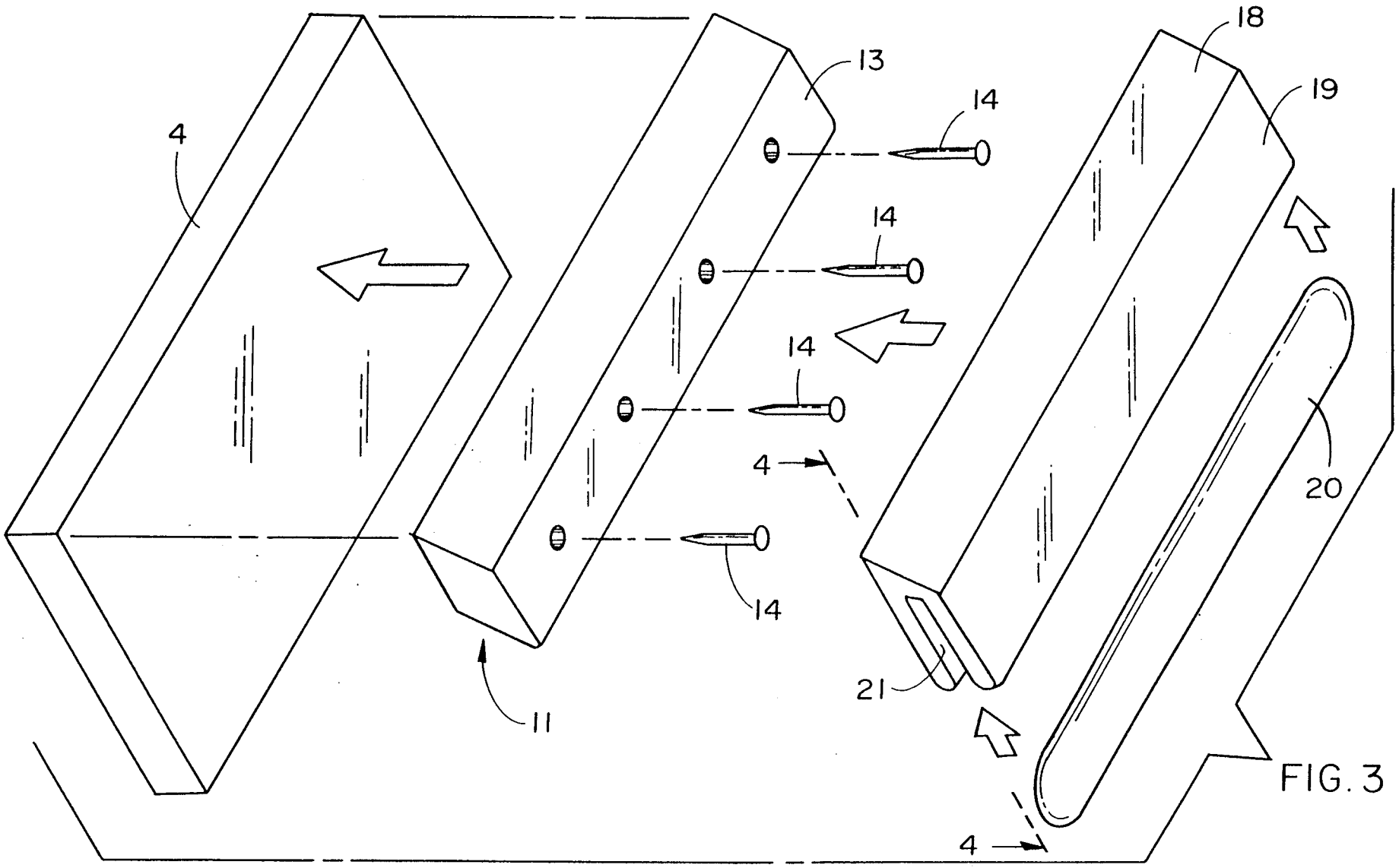
FIG. 3 is an exploded perspective view of the device of the present invention.
Figure 7:
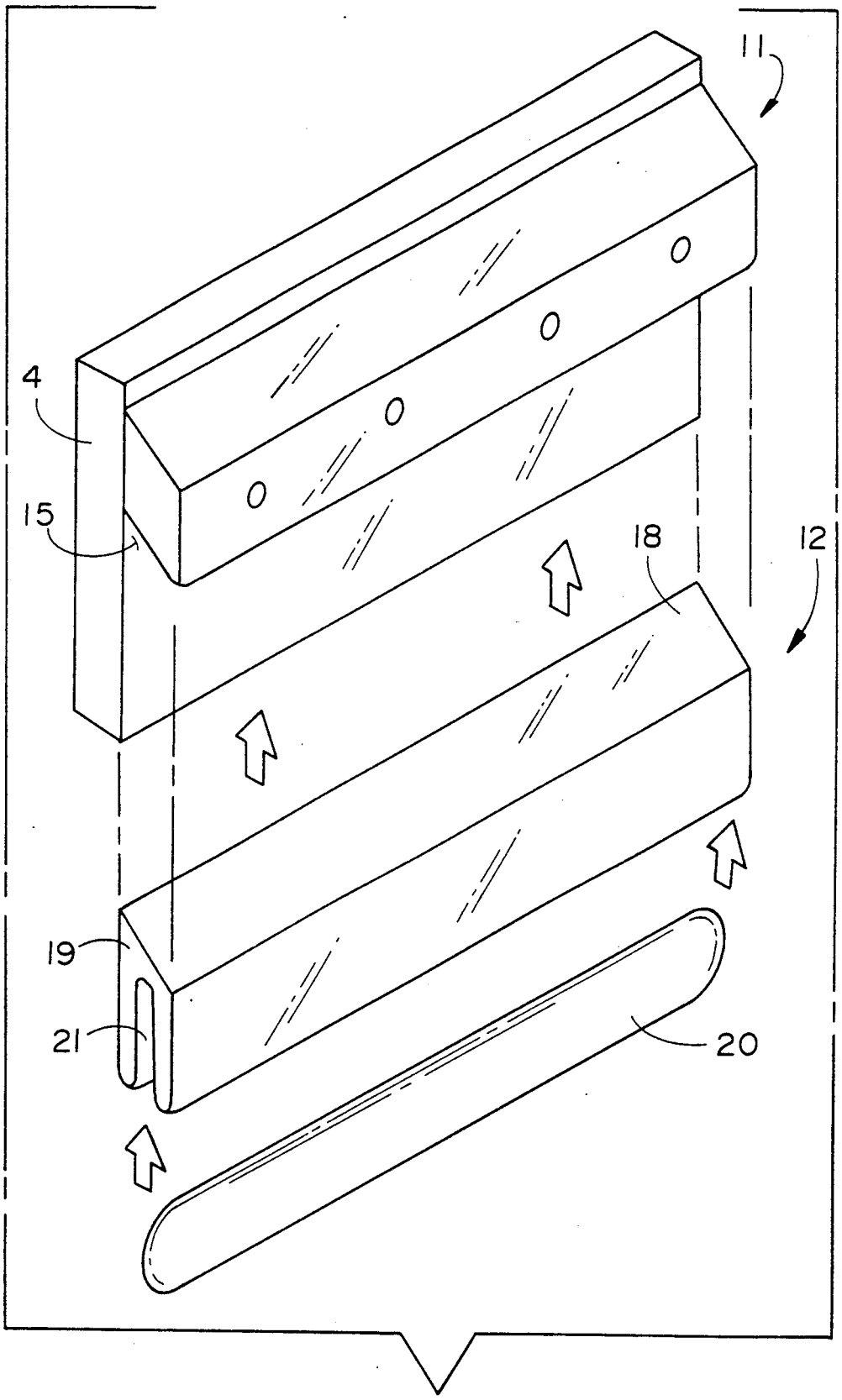
FIG. 7 is an exploded view of an alternative arrangement of the present invention wherein the stabilizing means is formed directly in the side frame members of the waterbed.

With particular reference now to FIGS. 2, 3 and 7, the present invention 10 includes respective stabilizing means (devices) 11. These stabilizing means 11 are carried by each of the side frame members 4 substantially along the side edges 7 of the sheet 6, preferably, 1 ½ inches from the top thereof. These stabilizing means 11 may either be formed as separate elements (such as stabilizing strips 13) that are disposed on and fixed to the side frame members 4 by respective fixing means, such as bolts, 14 (see FIGS. 2 and 3), or the stabilizing means 11 may be integrally formed in the side frame members 4 themselves (FIG. 7) by undercutting the inner top side face of the members 4. Further, there may be provided, either a pair of such stabilizing means 11, each of which runs along substantially the length of a respective side frame members 4 (see FIGS. 2, 3 and 7), or a plurality of such stabilizing means 11 may be provided that are equidistantly-spaced substantially along the length of each of the respective side frame members 4 (see FIG. 8).

The stabilizing means 11 are, preferably, in the form of elongated strips 13. These strips 13 have a tapered or chamfered bottom edge or surface, or are otherwise formed so that, when fixed to the side frame members 4 (at, preferably, the top inner side face thereof), a notch 15 is formed or defined therebetween. The edges of the strip are rounded so as to reduce the possibility of damaging the sheet and the mattress Thus formed, the stabilizing means 11 are, preferably, carried by each side frame member 4, so as to be disposed between the side frame members 4 and the mattress 2 above the space 5 that is defined therebetween.

Referring in particular now to FIGS. 2–7 and 9–11, the present invention further includes retaining means (device) 12 that is removably fitted over the side edges 7 of the sheet 6, being removably secured thereto, lengthwise thereof. The retaining means 12 may take any particular form, but, with reference to FIGS. 2–7 and 11, it is preferred that the retaining means 12 include retainer clips 19 and mating insert retainers 20. The precise number of clips 19 and inserts 20 to utilize will correspond to the number of stabilizing means 11 provided.

The retaining means 12 (with the side edge 7 of the sheet 6 carried thereby) is received below the stabilizing means 11 in the space 5 defined between the side frame members 4 and the water-filled mattress 2. The top 18 of the retaining means 12 is formed being tapered coincident to the shape of the notch 15, so as to mate with (the notch 15 in) the stabilizing means 11. In this fashion, the retaining means 12 is retained between the side frame members 4, the stabilizing means 11 and the mattress 2, so that the retaining means 12 can pivot slightly about the notch 15 in the space 5 below the stabilizing means 11 (see FIG. 2). This eliminates stress and permits accommodation of the movement of the sheet 6 due to the stress that is placed thereon during normal use of the waterbed 2. Furthermore, the retaining means 12 will thereafter pivot back to its normal position under the influence of the water-filled mattress 2. Finally, when the stress on the sheet 6 is removed, the sheet 6 will return to its normal smooth position without being substantially creased, thereby enhancing the comfort and pleasure of the waterbed 2.

Each retainer clip 19 has an uppermost portion 18 that is tapered, being formed or shaped coincident to the shape of the respective notch(es) 15. In this fashion, the clip mates with the notch 15, so as to be removably received and secured (retained in place) thereby or therein. Formed thusly, the retainer clips 19 are able to pivot slightly, as described above, in the space 5 between the side frame members 4 and the mattresses 2. in response to the various pressures on the sheet 6 during the use of the waterbed 1.

Figure 9:
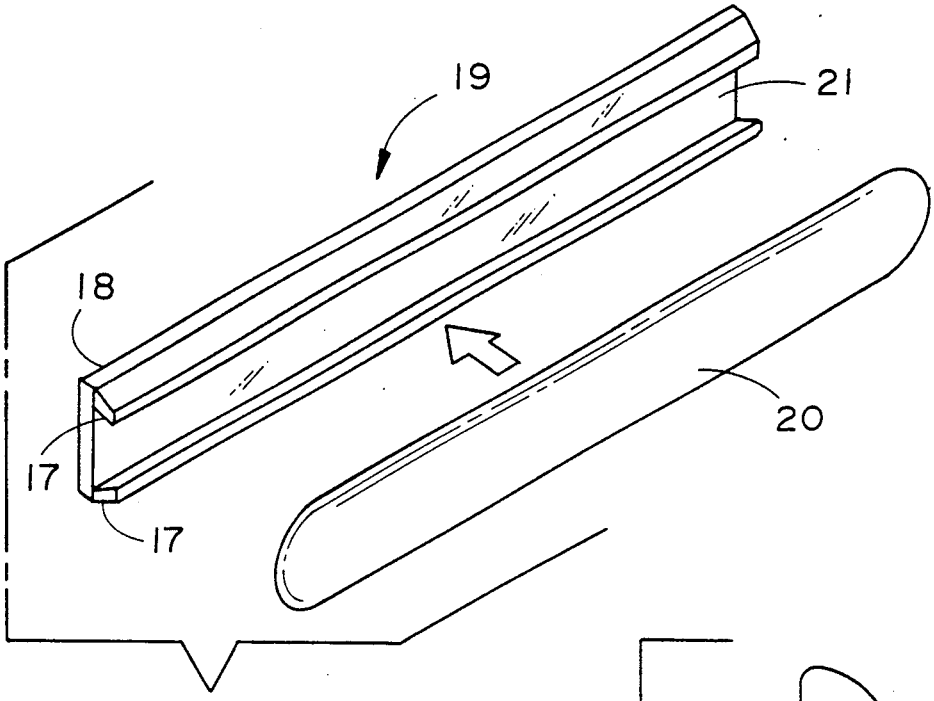
FIG. 9 is a perspective view of another embodiment of the retaining means of the present invention.
Figure 10:
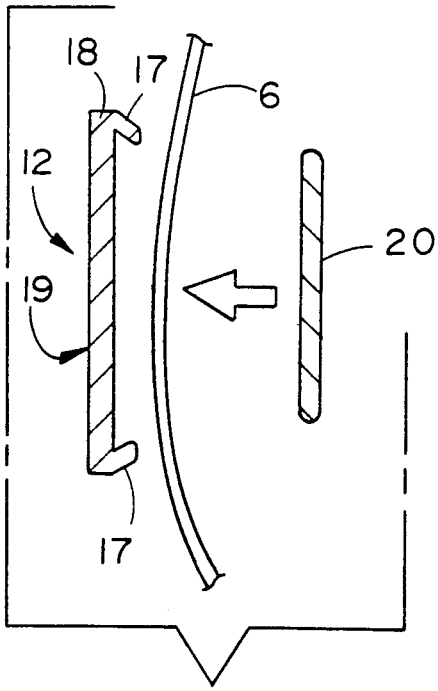
FIG. 10 is a side view of the device of FIG. 9, illustrating the positioning of the sheet between the elements thereof.
Figure 11:
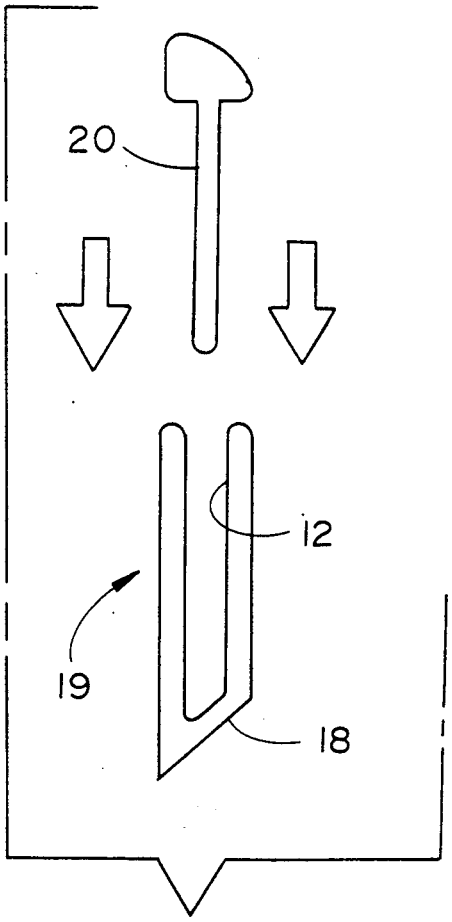
FIG. 11 is a side view of yet another embodiment of the retaining means of the present invention.

Finally, each retainer clip 19 further has a respective longitudinal groove (clamping groove) 21 formed therein. In this respect, the clip 19 may either take a substantially U-shaped (FIGS. 2 and 11) or a substantially C-shape (FIGS. 9 and 10) appearance. In the latter case, the groove is bounded by a pair of resilient flanges 17 (FIGS. 9 and 10). The retainer clip 19 may also be disposed lower on the side frame member 4 with the clamping groove 21 directed upwardly toward the stabilizing means 11. The insert retainer 20 for this configuration has one end sized to be received in the clamping groove 21 and the opposite end of the insert retainer extends outwardly from the retainer as a flange and the end is arcuate to be received in the notch in the stabilizing means (FIG. 11).

Figure 6:
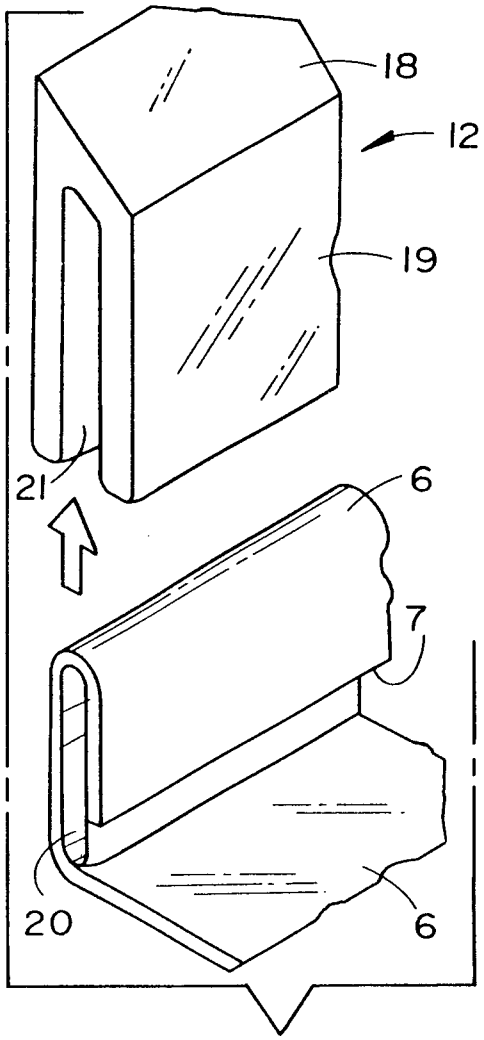
FIG. 6 is a further perspective view of the retainer means illustrating the sheet looped over a portion thereof.
Figure 5:
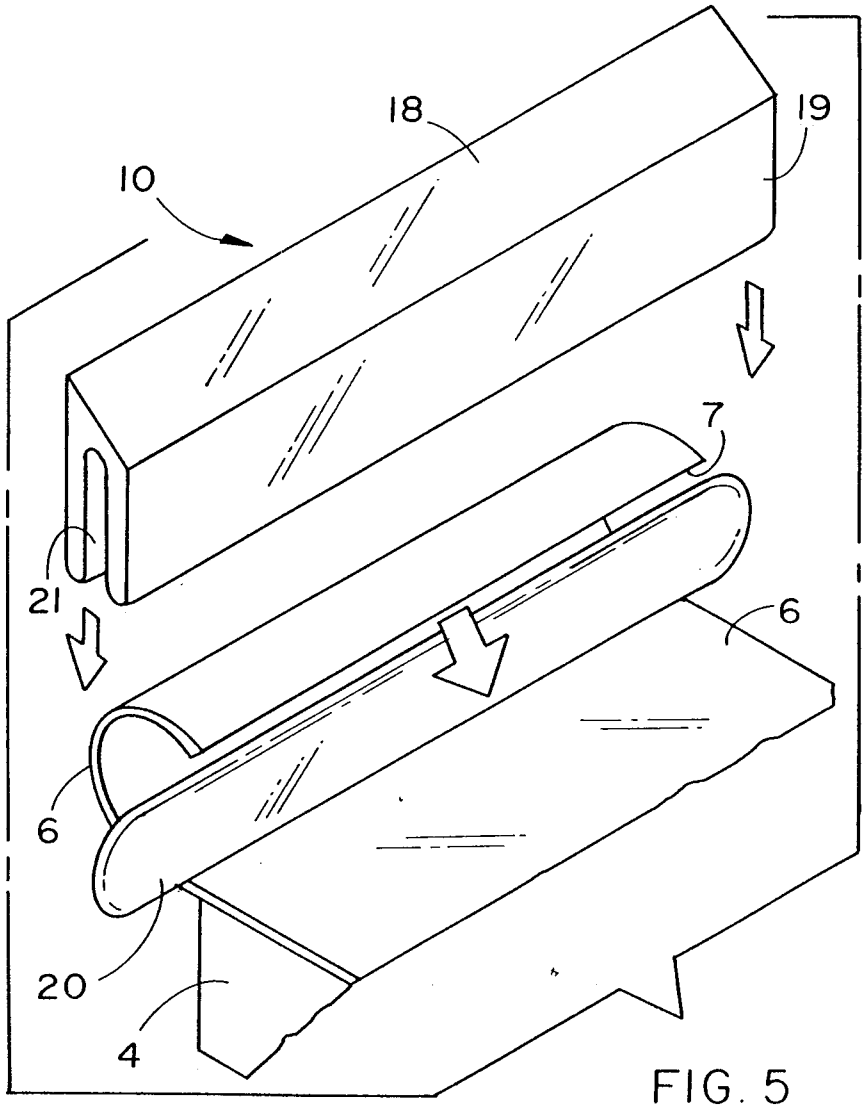
FIG. 5 is a perspective view of the retainer means illustrating how a sheet is looped over a portion thereof.
Figure 4:
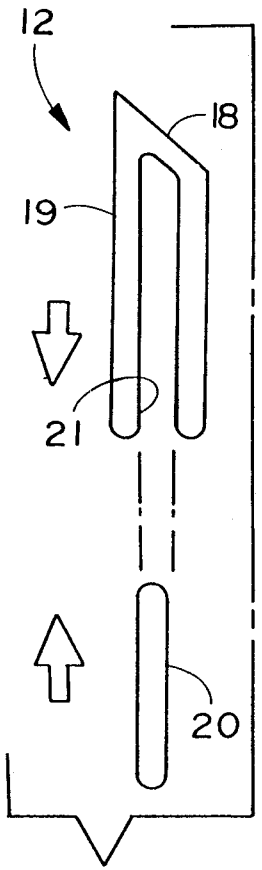
FIG. 4 is a side view of the retainer means taken along lines 4—4 of FIG. 3.

The mating insert retainers 20 are disposed along the side edges 7 of the sheets 6, preferably with (in this embodiment) the side edges 7 looped over the insert retainers 20, as seen in FIGS. 2, 5 and 6. It is to be understood however that, alternatively, the edges of the sheet may merely be located, positioned or disposed therebetween (FIG. 10).

Each insert retainer 20 is sized, so as to be at least partially received in the respective grooves 21 of the retainer clips 19 with the edges 7 of the sheet 6 looped thereover. In this fashion the edges 7 of the sheet 6 (and the insert retainers 20) are secured and retained on the bed 1 (in the grooves 21 of the clips 19) by the retaining means 12. The edges of the retainer clip 19 and the insert retainer 20 are rounded and smooth so as to reduce the possibility of damaging the sheet and the mattress.

Figure 12:
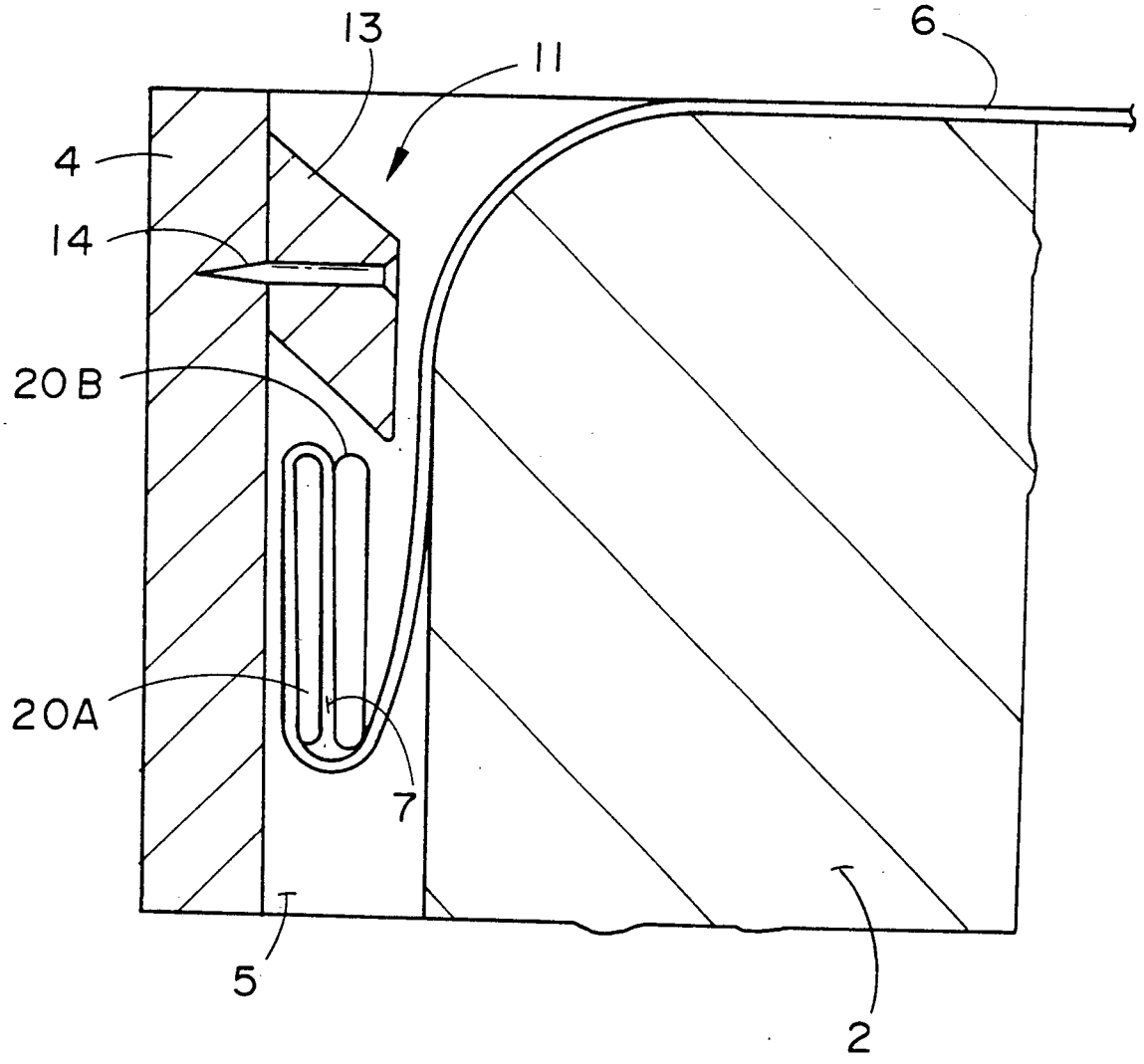
FIG. 12 is a perspective view of another embodiment of the retaining means of the present invention.

In another embodiment (as shown in FIG. 12), the retaining means 12 comprises a pair of insert retainers 20. The side edge 7 of the sheet 6 is looped completely around a first insert retainer 20*a*, a second insert retainer 20*b* is placed between the body of the sheet 6 and the side edge 7 of the sheet 6, adjacent to the first insert retainer 20*a* such that the side edge 7 of the sheet 6 is held securely between the insert retainers 20*a*, 20*b*. The sheet 6 having the insert retainers 20*a*, 20*b* wrapped therein is disposed in the space 5 between the mattress 2 and the side wrapped thereabout are received below the stabilizing means 11 and retained between the side frame members 4 and the mattress 2.

In a preferred embodiment, a flexible tab 25 is attached to the second insert retainer 20*b*. This tab 25 enables the user to more easily grasp the insert retainer 20*a* which is nearest to the mattress 2 and to pull on the tab 25 to release the insert retainer 20*a* from the stabilizing means 11. This permits the user to more rapidly and easily remove the sheet from between the mattress 2 and the side frame member 4.

As can be seen, the number of retaining means 12 to employ will, preferably, be the same as the number of stabilizing means 11. That is to say, either a pair of retaining means 12 that run lengthwise along substantially the entire length of the bed, or a plurality of retaining means 12 that are disposed lengthwise along substantially the entire length of the bed (see FIG. 8). However, it is to be understood that variations could occur.

It is also noted herein that while the stabilizing means 11 and the retaining means 12 of the present invention are illustrated and discussed as being located between the side frame members 4 and the mattress 2, other locations could also be employed.

In use then, when making the bed 1, if a two-piece retaining means 12 is used, the side edges 7 of the sheet 6 are removably fitted between the pieces 19 and 20 of the retaining means 12, so that the retaining means 12 is removably secured thereto on each side of the bed lengthwise thereof (FIG. 5).

Next, a normal flat sheet is positioned over the bed as if to make the bed. The retaining means 12 and the sheet 6 are then tucked between the frame 3 and the mattress 2, substantially even with the stabilizing means 11 (FIG. 6). The water-filled mattress 2 will give as the retainer means 11 and the sheet 6 are pushed down into the respective spaces 5. The retaining means 12 are then positioned or tucked under the respective stabilizing means 11. The mattress 2 will tend to push the retaining means 12 against the inner side face of the side frame members 4.

with both sides in place, the sheet 6 is positively gripped and free-floating, so as not to cause unnecessary stress or tension on the sheet or retainers. As the water-filled mattress 2 tends to move during usage of the bed 1, the retaining means 12 (located below the stabilizing means 11) will tend to shift or pivot slightly (within the confines of the space 5 as indicated by the arrow of FIG. 2) and to spring back into place and to keep the sheet 6 taut on the mattress 2, regardless of the movement of the person(s) on the bed. The net result is that the sheet 6 is kept nice and smooth and is not wrinkled or pulled away from the mattress 2. The sheet 6 will remain in place until it is ready to be removed. Thus, the use of this device eliminates the labor intensive and disturbing need to frequently remake the bed caused by separation of the sheet from the mattress.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In a waterbed including a water-filled mattress having respective sides and further including a pair of respective side frame members running lengthwise of the bed, such that a space is formed between each side frame member and a respective side of the water-filled mattress, and wherein the waterbed is provided with a sheet covering the mattress, the sheet having respective side edges, the improvement which comprises a stabilizing means carried by each side frame member and disposed above the space between the respective side frame member and the water-filled mattress, and a retaining means fitted over the side edge of the sheet and removably secured thereto lengthwise thereof, the retaining means with the side edge of the sheet carried thereby being received below the stabilizing means and in the space between the side frame member and the water-filled mattress, such that the retaining means can pivot slightly in the space below the stabilizing means to accommodate movement of the sheet due to stress thereon during normal use of the waterbed, and such that the retaining means will thereafter pivot back to its normal position under the influence of the water-filled mattress and once the stress on the sheet is removed, whereby the sheet will be retained on the mattress and will return to its normal smooth position without being substantially creased, thereby enhancing the comfort and pleasure of the waterbed.

2. The improvement of claim 1, wherein the stabilizing means is a strip disposed on each respective side frame member, so as to form a notch therebetween.

3. The improvement of claim 2, wherein the stabilizing means includes a plurality of strips disposed on each respective side frame, so as to form respective notches therebetween.

4. The improvement of claim 3, wherein the retaining means is a plurality of retainer clips having respective longitudinal grooves formed therein, the retainer clips being tapered coincident to respective notches, so as to mate with respective tapered strips, such that the retainer clips are removably secured by the respective stabilizing means, a plurality of insert retainers disposed along the respective side edges of the sheet with the said respective side edges looped thereover, the insert retainers sized so as to be at least partially received in the respective grooves of the retainer clips for securing and retaining the edges of the sheet therein, whereby the sheet is secured and retained on the waterbed.

5. The improvement of claim 1, wherein the stabilizing means comprises the side frame members each having an undercut therein so as to form a notch therein.

6. The improvement of claim 1, wherein the retaining means is a pair of retainer clips having respective longitudinal grooves formed therein, the retainer clips formed, so as to be removably secured by the respective stabilizing means, a pair of insert retainers disposed along a respective side edge of the sheet with the said respective side edges looped thereover, the insert retainers sized so as to be at least partially received in the respective grooves of the retainer clips for securing and retaining the edges of the sheet therein, whereby the sheet is secured and retained on the bed.

7. The improvement of claim 6, wherein the stabilizing means is a tapered strip disposed on a respective side frame member, so as to form a notch therebetween, the retainer clip being tapered coincident to the notch, so as to mate with the tapered strip, such that the retainer clip is retained by the tapered strip, and further such that the retainer clip can pivot slightly to accommodate movement of the sheet due to the stress thereon during use of the waterbed.

8. The improvement of claim 1, wherein the retaining means is a pair of insert retainers, the side edge of the sheet being looped completely about a first insert retainer, a second insert retainer being disposed between the sheet and the side edge of the sheet adjacent to the first insert retainer such that the side edge of the sheet is secured between the insert retainers and whereby the sheet is secured and retained o the waterbed.

9. In a waterbed including a water-filled mattress having respective sides and further including a pair of respective side frame members running lengthwise of the bed, and wherein the waterbed is provided with a sheet covering the mattress, the sheet having respective side edges, the improvement which comprises a stabilizing means carried by each side frame member and a retaining means fitted over the side edge of the sheet and removably secured thereto lengthwise thereof, the retaining means with the side edge of the sheet carried thereby being received below the stabilizing means, such that the retaining means can pivot to accommodate movement of the sheet due to stress thereon during normal use of the waterbed, and such that the retaining means will thereafter pivot back to its normal position under the influence of the water-filled mattress and once the stress on the sheet is removed, whereby the sheet will be retained on the mattress and will return to its normal smooth position without being substantially creased, thereby enhancing the comfort and pleasure of the waterbed.

10. In the waterbed of claim 9, wherein the improvement thereon is further comprised of the stabilizing means being disposed on each respective side frame member between the side frame members and the mattress, and further wherein the retaining means is also disposed between the side frame members and the mattress.

11. A device for securing and retaining a sheet including side edges on the mattress of a waterbed having a pair of respective side frame members running lengthwise of the waterbed, the device comprised of: stabilizing means disposed on the respective side frame members along the side edges of the sheet; retaining means removably adjoined to the respective stabilizing means, whereby when the retaining means is secured to the stabilizing means, the respective edges of the sheet are secured and retained by the retaining means.

12. The device of claim 11, wherein the stabilizing means is a strip disposed on each respective side frame member, so as to form a notch therebetween.

13. The device of claim 12, wherein the stabilizing means includes a plurality of strips disposed on each respective side frame member, so as to form respective notches therebetween.

14. The device of claim 13, wherein the retaining means is a plurality of retainer clips having respective longitudinal grooves formed therein, the retainer clips being tapered coincident to respective notches, so as to mate with respective tapered strips, such that the retainer clips are removably secured by the respective stabilizing means, a plurality of insert retainers disposed along the respective side edges of the sheet with the said respective side edges looped thereover, the insert retainers sized so a to be at least partially received in the respective grooves of the retainer clips for securing and retaining the edges of the sheet therein , whereby the sheet is secured and retained on the waterbed.

15. The device of claim 11, wherein the stabilizing means comprises the side frame members each having an undercut therein so as to form a notch therein.

16. The device of claim 11, wherein the retaining means is a pair of retainer clips having respective longitudinal grooves formed therein, the retainer clips formed, so as to be removably secured by the respective stabilizing means, a pair of insert retainers disposed along a respective side edge of the sheet with the said respective side edges looped thereover, the insert retainers sized so as to be at least partially received in the respective grooves of the retainer clips for securing and retaining the edges of the sheet therein, whereby the sheet is secured and retained on the waterbed.

17. The device of claim 16, wherein the stabilizing means is a tapered strip disposed on each respective side frame member, so as to form a notch therebetween, the retainer clip being tapered coincident to the notch, so as to mate with the tapered strip, such that the retainer clip is retained by the tapered strip, and further such that the retainer clip can pivot slightly to accommodate movement of the sheet due to the stress thereon during use of the waterbed.

18. The device of claim 11, wherein the retaining means is a pair of insert retainers, the side edge of the sheet being looped completely about a first insert retainer, a second insert retainer being disposed between the sheet and the side edge of the sheet adjacent to the first insert retainer such that the side edge of the sheet is secured between the insert retainers and whereby the sheet is secured and retained on the waterbed.

19. The device of claim 18, further comprising a tab attached to the second insert retainer such that the tab may be easily grasped to release the insert retainer from the stabilizing means permitting removal of the sheet.

20. The device of claim 11, wherein the stabilizing means is a strip disposed on each respective side frame member, the strips having respective clamping grooves formed therein.

21. The device of claim 20, wherein the retaining means is an insert retainer for being inserted and retained in a respective clamping groove with the sheet therebetween, such that the sheet is secured and retained on the bed.

22. The device of claim 11, wherein the stabilizing means is disposed between the side frame members and the mattress, wherein the retaining means is joined to the stabilizing means below the stabilizing means and between the side frame members and the mattress, such that the retaining means can pivot slightly to accommodate movement of the sheet due to stress thereon during normal use of the waterbed, and such that the retaining means will thereafter pivot back into its normal position under the influence of the mattress and once the stress on the sheet is removed, whereby the sheet will be retained on the mattress and will return to its normal smooth position without being substantially creased, thereby enhancing the comfort and pleasure of the waterbed.

23. A device for securing and retaining a sheet including side edges on the mattress of a waterbed having a pair of respective side frame members running lengthwise of the bed, the device comprised of: a pair of stabilizer strips disposed along the side edges of the sheet and secured to the respective side frame members between the side frame members and the mattress, such that a respective notch is defined between the strips and the respective side frame members; a pair of retainer clips being tapered-coincident to the respective notches, so as to be removably adjoinable to the respective stabilizer strips with the respective side edges of the sheet, such that the retainer clips may pivot about the notch between the side frame members and the mattress, each of the retainer clips having a respective longitudinal groove formed therein; and a pair of insert retainers disposed along the side edges of the sheet with the side edges of the sheet looped over the insert retainers, the insert retainers further being sized, so as to be inserted in the respective longitudinal grooves in the retaining clips between the side frame members and the mattress, whereby when the retaining inserts are disposed in the longitudinal grooves of the retainer clips, the respective edges of the sheet are secured and retained therein; such that the retainer clip and the insert retainers can pivot slightly between the side frame members and the mattress to accommodate movement of the sheet due to stress thereon during normal use of the waterbed such that the retaining means will thereafter pivot back to its normal position under the influence of the mattress and once the stress on the sheet is removed, whereby the sheet will be retained on the mattress and will return to its normal smooth position without being substantially creased, thereby enhancing the comfort and pleasure of the waterbed.

* * * * *

UNITED STATES PATENT AND TRADEMARK OFFICE

CERTIFICATE OF CORRECTION

PATENT NO. : 5,044,028

DATED : September 3, 1991

INVENTOR(S) : Sleeth

It is certified that error appears in the above-identified patent and that said Letters Patent is hereby corrected as shown below:

Column 3, line 45, "bed I along" should read -- bed 1 along -- .

Column 5, line 31, "side wrapped" should read -- side frame member 4. The insert retainers 20a, 20b having the sheet 6 wrapped -- .

Column 6, line 5, "with" should read -- With -- .

Column 7, line 37, "o" should read -- on -- .

Signed and Sealed this

Second Day of February, 1993

*Attest:*

STEPHEN G. KUNIN

*Attesting Officer*

*Acting Commissioner of Patents and Trademarks*